US009033701B1

(12) United States Patent
McWilliams

(10) Patent No.: US 9,033,701 B1
(45) Date of Patent: May 19, 2015

(54) SELF-FILLING CANDLE

(76) Inventor: Aaron P. McWilliams, Hillsborough, ND (US)

( * ) Notice: Subject to any disclaimer, the term of this patent is extended or adjusted under 35 U.S.C. 154(b) by 456 days.

(21) Appl. No.: 13/418,919

(22) Filed: Mar. 13, 2012

Related U.S. Application Data

(60) Provisional application No. 61/453,063, filed on Mar. 15, 2011.

(51) Int. Cl.
*F23D 3/16* (2006.01)
*C11C 5/00* (2006.01)

(52) U.S. Cl.
CPC ..... *C11C 5/008* (2013.01)

(58) Field of Classification Search
CPC ..... B65D 1/22; C11C 5/002; C11C 5/006; C11C 5/008; F21V 35/006; F23D 3/16; F21L 17/00; F21W 2121/002
USPC ..... 431/292, 289
See application file for complete search history.

(56) References Cited

U.S. PATENT DOCUMENTS

| | | | | |
|---|---|---|---|---|
| 3,000,753 | A * | 9/1961 | Rockland | 431/288 |
| 4,507,077 | A * | 3/1985 | Sapper | 431/288 |
| 4,759,709 | A * | 7/1988 | Luken et al. | 431/288 |
| 4,855,098 | A | 8/1989 | Taylor | |
| 5,078,591 | A | 1/1992 | Despres | |
| 5,078,945 | A * | 1/1992 | Byron | 264/278 |
| D397,459 | S | 8/1998 | Hsu | |
| 6,220,855 | B1 * | 4/2001 | Asheim | 431/294 |
| 6,371,755 | B1 | 4/2002 | Dearth | |
| 6,409,501 | B1 | 6/2002 | Pappas | |
| 7,959,689 | B2 | 6/2011 | Cagle | |
| 2003/0049577 | A1 * | 3/2003 | Steck | 431/288 |
| 2003/0104330 | A1 * | 6/2003 | Joyner | 431/288 |
| 2004/0137392 | A1 * | 7/2004 | Garnys | 431/126 |
| 2005/0037308 | A1 * | 2/2005 | Decker | 431/325 |
| 2007/0169404 | A1 * | 7/2007 | Cagle | 44/275 |
| 2007/0169405 | A1 * | 7/2007 | Cagle | 44/275 |
| 2009/0067164 | A1 * | 3/2009 | Ambroggio et al. | 362/161 |
| 2011/0256492 | A1 * | 10/2011 | Navarro | 431/289 |
| 2014/0004472 | A1 * | 1/2014 | Tovanyan | 431/288 |
| 2014/0134554 | A1 * | 5/2014 | Hurst et al. | 431/289 |
| 2014/0170578 | A1 * | 6/2014 | Leach et al. | 431/289 |
| 2015/0024329 | A1 * | 1/2015 | Navarro | 431/289 |

* cited by examiner

*Primary Examiner* — Avinash Savani
*Assistant Examiner* — George R Blum
(74) *Attorney, Agent, or Firm* — Neustel Law Offices

(57) ABSTRACT

A self-filling candle which fills itself with melted wax to form a second candle for additional burning. The self-filling candle generally includes a hollow candle body having a cavity extending therein from an upper opening. The candle body one or more layers of wax, wherein an outer layer of wax has a higher burning point than the one or more interior layers. A first wick is helically wound through the middle layer of wax in the candle body. As the first wick is burned, melted wax will pool and collect in the cavity to form a second candle. A second wick is positioned in the lower surface of the cavity, which will be utilized to burn the second candle after it has been formed.

13 Claims, 7 Drawing Sheets

SELF-FILLING CANDLE

CROSS REFERENCE TO RELATED APPLICATIONS

I hereby claim benefit under Title 35, United States Code, Section 119(e) of U.S. provisional patent application Ser. No. 61/453,063 filed Mar. 15, 2011. The 61/453,063 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a candle and more specifically it relates to a self-filling candle which fills itself with melted wax to form a second candle for additional burning.

2. Description of the Related Art

Any discussion of the related art throughout the specification should in no way be considered as an admission that such related art is widely known or forms part of common general knowledge in the field.

Candles have been in use for many centuries. Typically, a candle is formed of a solid piece of wax with a wick extending therein. When such conventional, prior art candles are burned, melted wax must constantly be emptied to prevent the wick from burning out. The disposal of such melted wax can be messy and difficult, particularly considering its heat. Further, the melted max is usually disposed of, which can be wasteful.

Because of the inherent problems with the related art, there is a need for a new and improved self-filling candle for which fills itself with melted wax to form a second candle for additional burning.

BRIEF SUMMARY OF THE INVENTION

The invention generally relates to a self-filling candle which includes a hollow candle body having a cavity extending therein from an upper opening. The candle body is comprised of one or more layers, wherein an outer layer of wax has a higher burning point than the one or more interior layers. A first wick is helically wound through the middle layer of wax in the candle body. As the first wick is burned, melted wax will pool and collect in the cavity to form a second candle. A second wick is positioned in the lower surface of the cavity, which will be utilized to burn the second candle after it has been formed.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
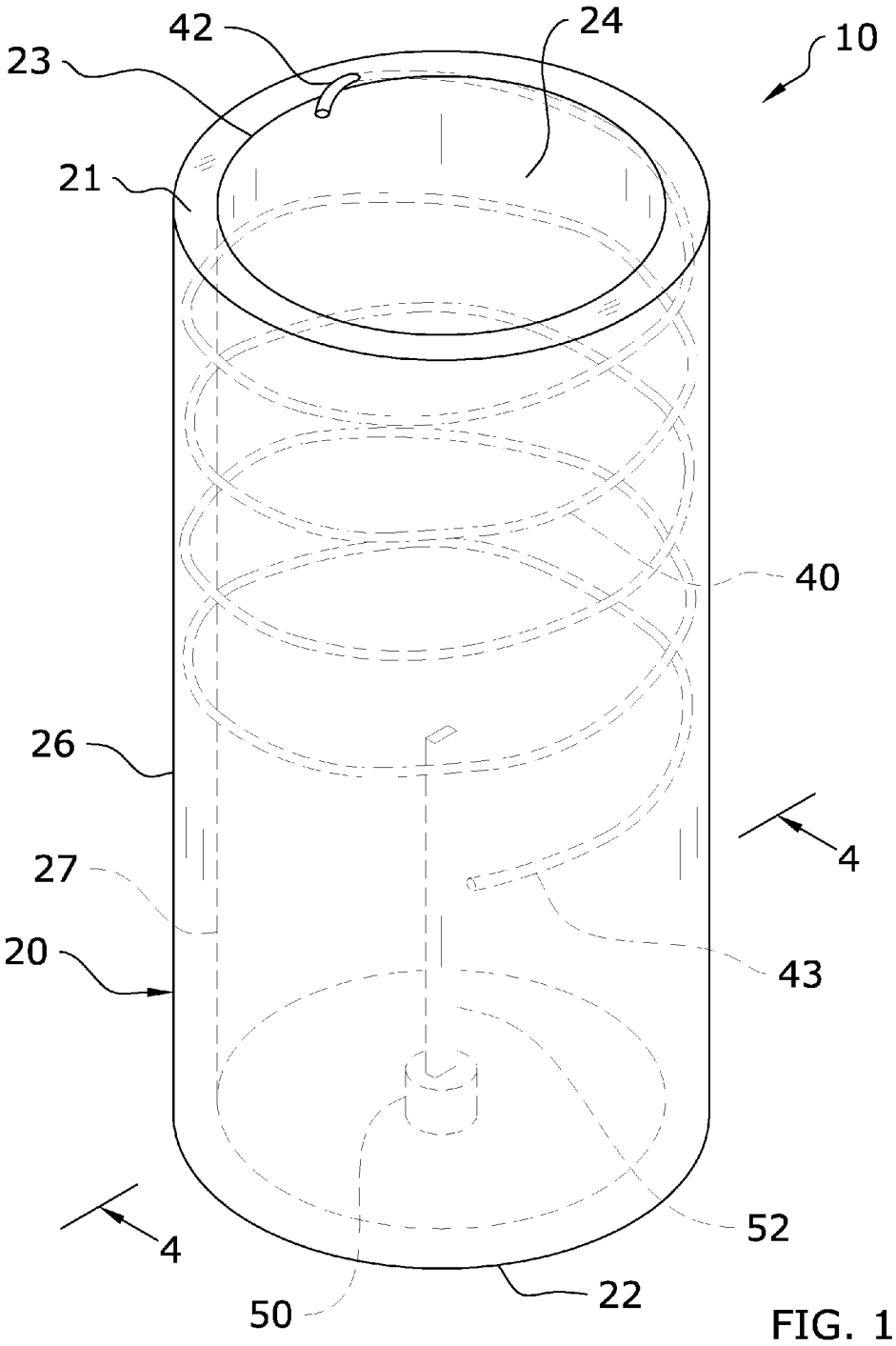
FIG. 1 is an upper perspective interior view of the present invention.

Turning now descriptively to the drawings, in which similar reference characters denote similar elements throughout the several views, FIGS. 1 through 6 illustrate a self-filling candle 10, which comprises a hollow candle body 20 having a cavity 24 extending therein from an upper opening 23. The candle body 20 is comprised of one or more layers of wax 30, 32, wherein an outer layer 30 of wax has a higher burning point than the one or more interior layers 32, 34. A first wick 40 is helically wound through the middle layer 32 of wax in the candle body 20. As the first wick 40 is burned, melted wax will pool and collect in the cavity 24 to form a second candle. A second wick 52 is positioned in the lower surface 25 of the cavity 24, which will be utilized to burn the second candle after it has been formed.

B. Candle Body

As shown in the figures, the self-filling candle 10 will generally be comprised of a candle body 20 having a central cavity 24 extending therethrough. In a preferred embodiment as shown in FIG. 1, the candle body 20 will be comprised of a hollow, cylindrical shape having an upper end 21 and a lower end 22. The upper end 21 of the candle body 20 may be diagonally cut in some embodiments.

Figure 2:
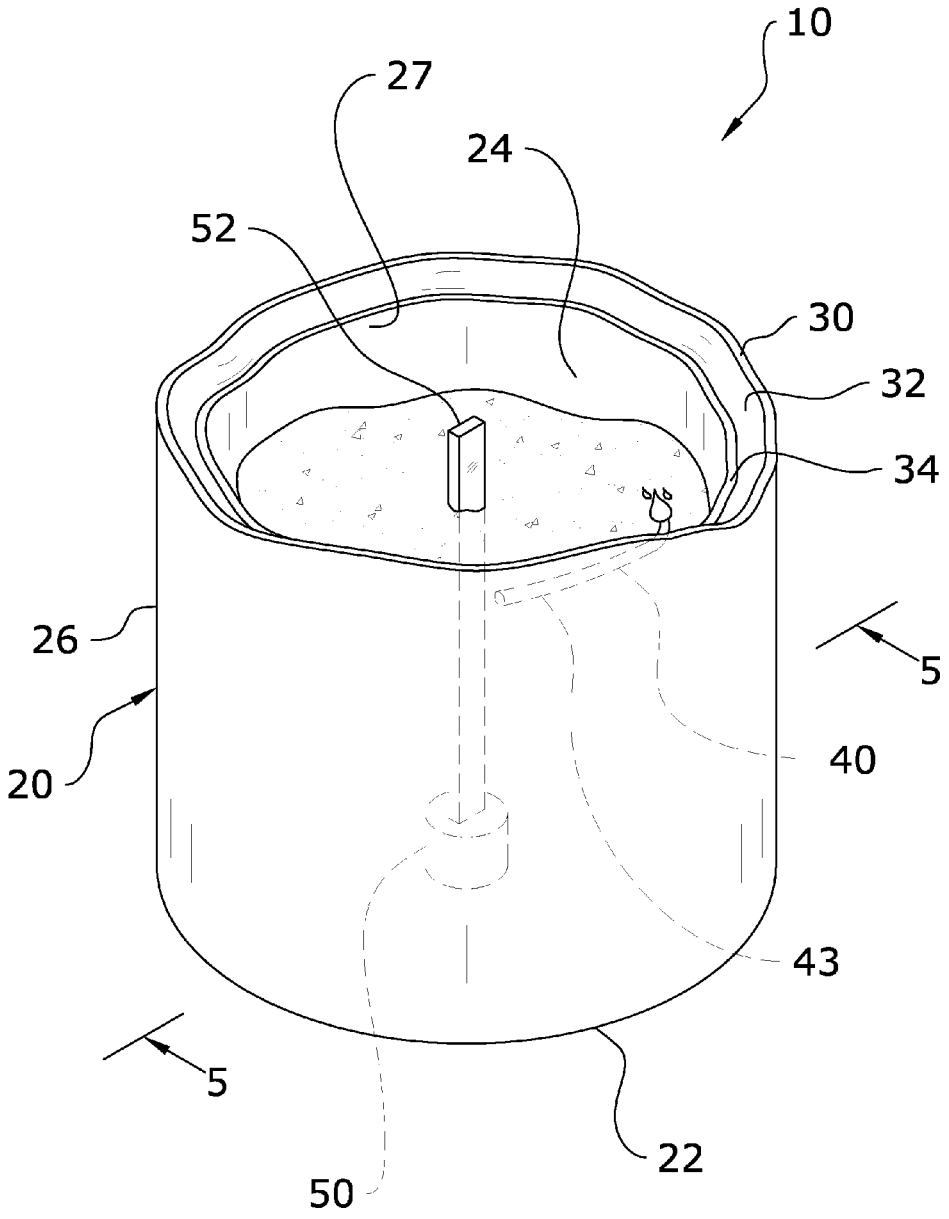
FIG. 2 is an upper perspective interior view of the present invention after initial burning of the first wick.
Figure 3:
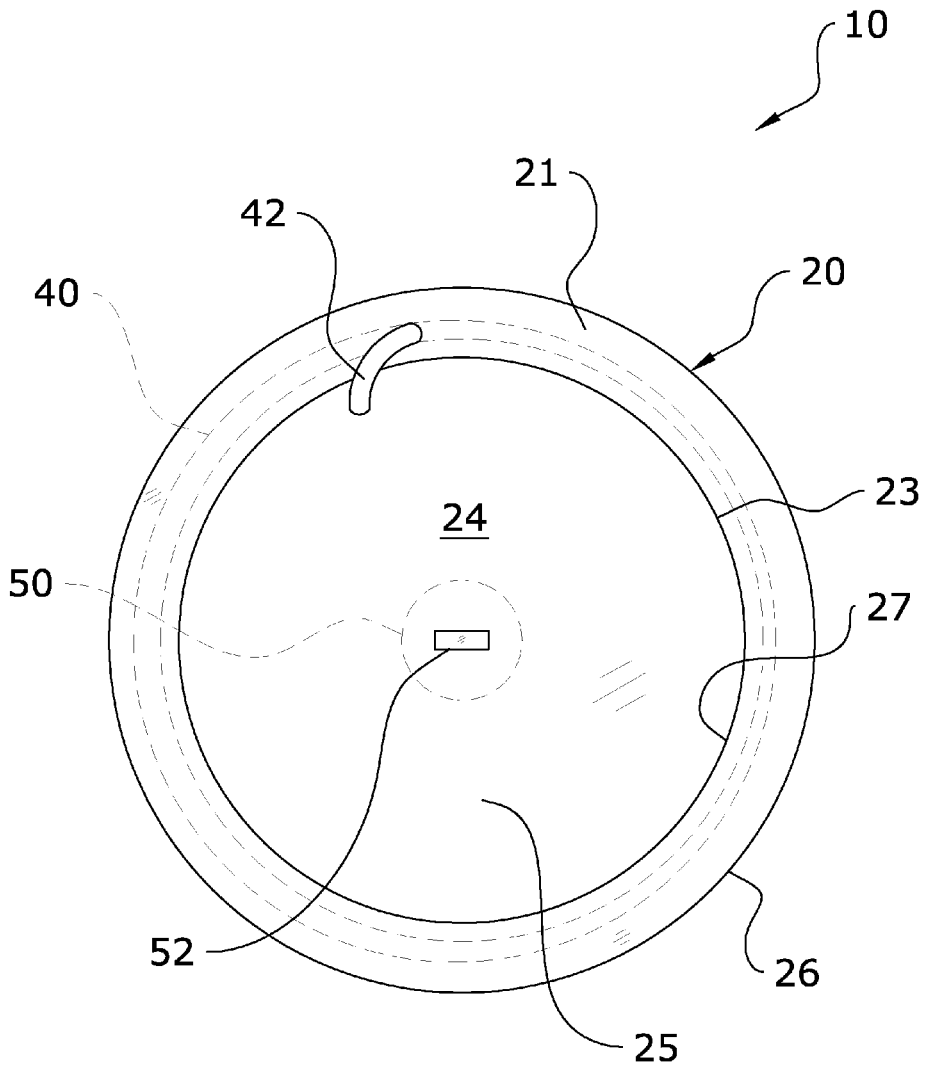
FIG. 3 is a top view of the present invention.

An upper opening 23 is formed in the upper end 21 which leads directly to an internal cavity 24 extending from an upper end 21 of the candle body 20 to its lower end 22. The lower end 22 of the candle body 20 is preferably enclosed to form a solid lower surface 25 of the candle body 20. As the sidewalls of the candle body 20 are melted during usage of the present invention, wax will fill the central cavity 24 to eventually form a second candle to utilize after the first has been used up as shown in FIG. 2.

Figure 4:
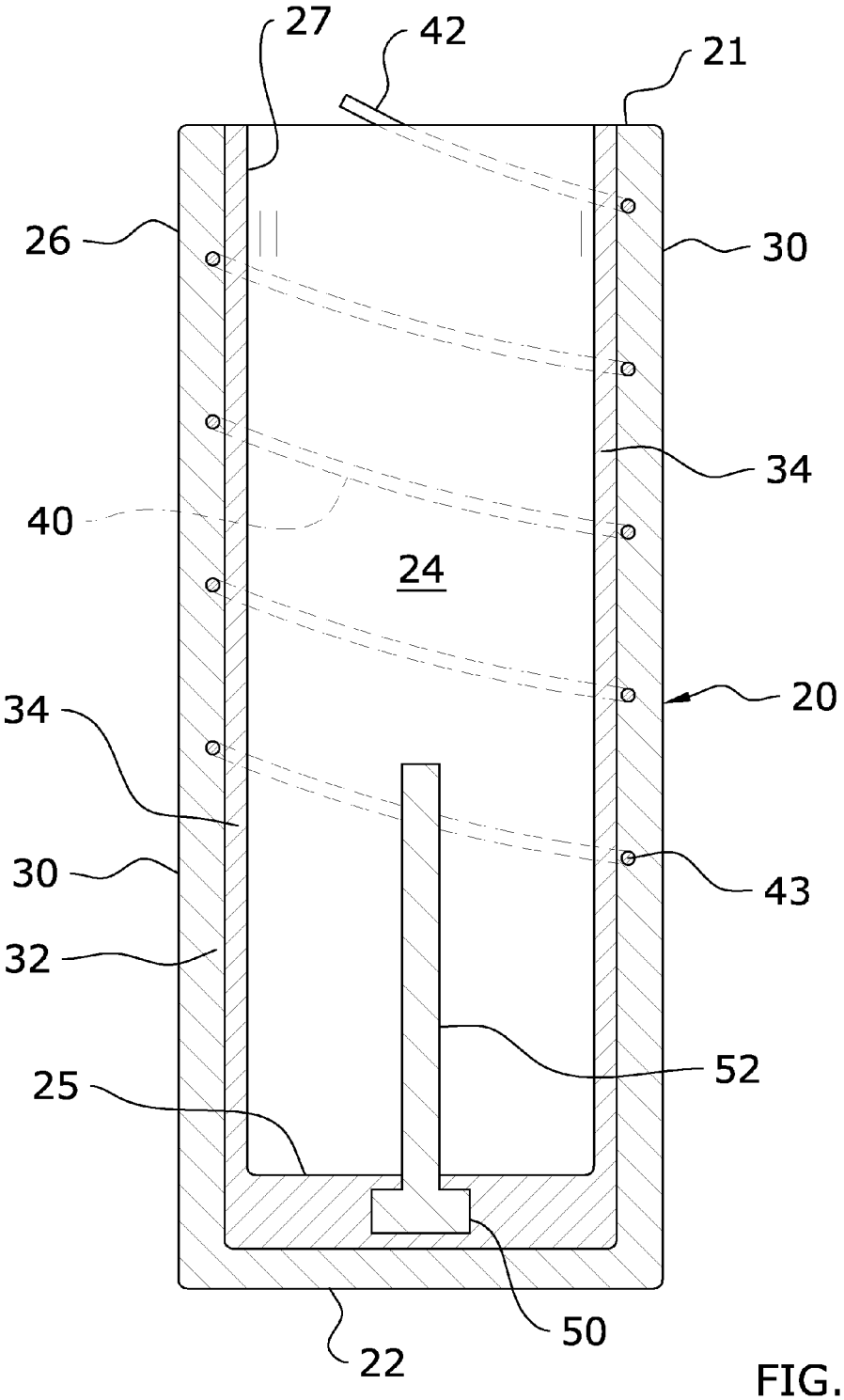
FIG. 4 is a side sectional view of a two-layer embodiment of the present invention taken along line 4-4 of FIG. 1.

Due to the cylindrical shape of a preferred embodiment of the present invention, the candle body 20 will additionally include an outer surface 26 comprised of the outer radius of the candle body 20 and an inner surface 27 comprised of the inner radius of the candle body 20 as shown in FIG. 4.

While the figures illustrate the use of a cylindrical candle body 20, it is appreciated that various other shapes and configurations may be utilized with the present invention. Thus, the scope of the present invention should not be construed as being limited to a cylindrically-shaped candle body 20. In some embodiments, various other shapes such as rectangular, triangular or the like may be utilized so long as a central cavity 24 is present to receive melted wax.

Figure 5:
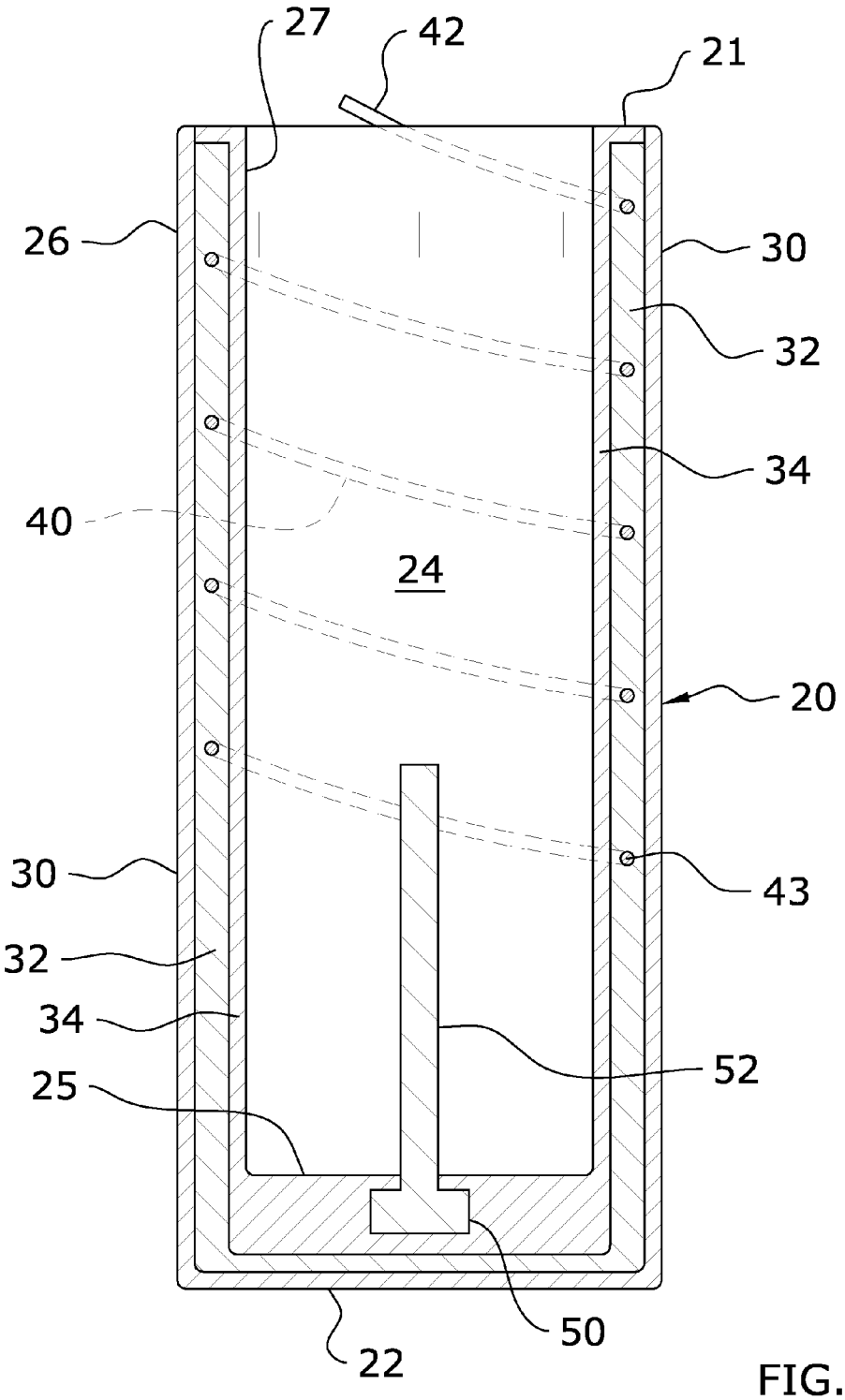
FIG. 5 is a side sectional view of a three-layer embodiment of the present invention taken along line 4-4 of FIG. 1.
Figure 6:
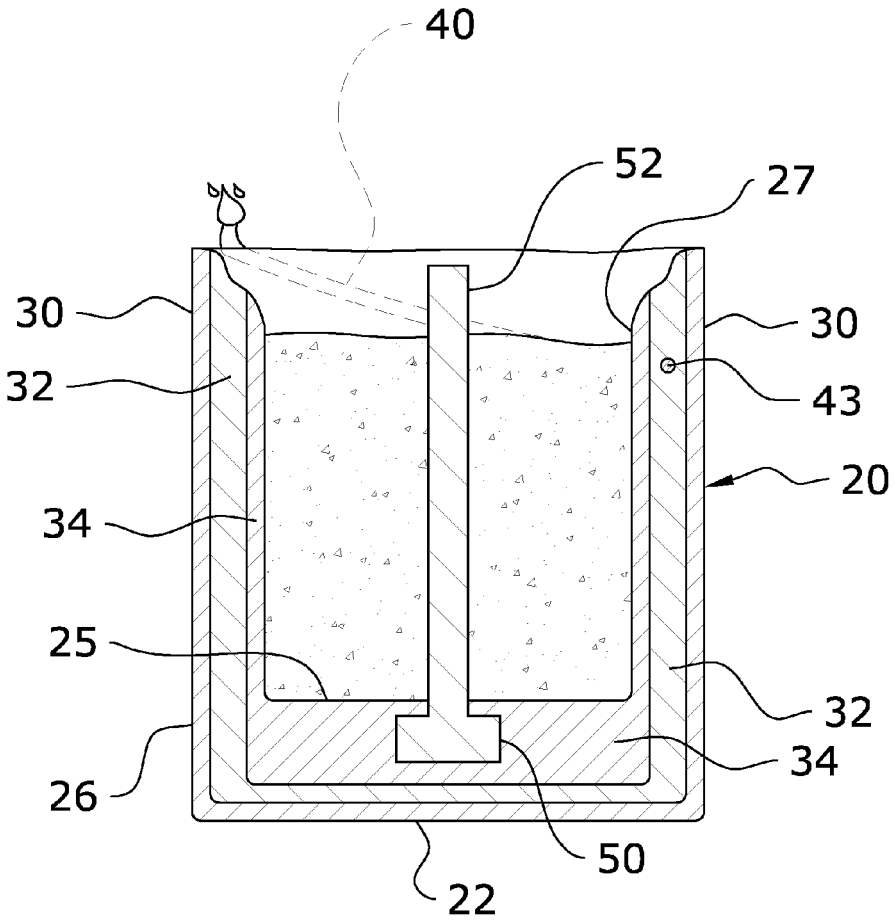
FIG. 6 is a side sectional view of the present invention after initial burning of the first wick taken along line 5-5 of FIG. 2.
Figure 7:
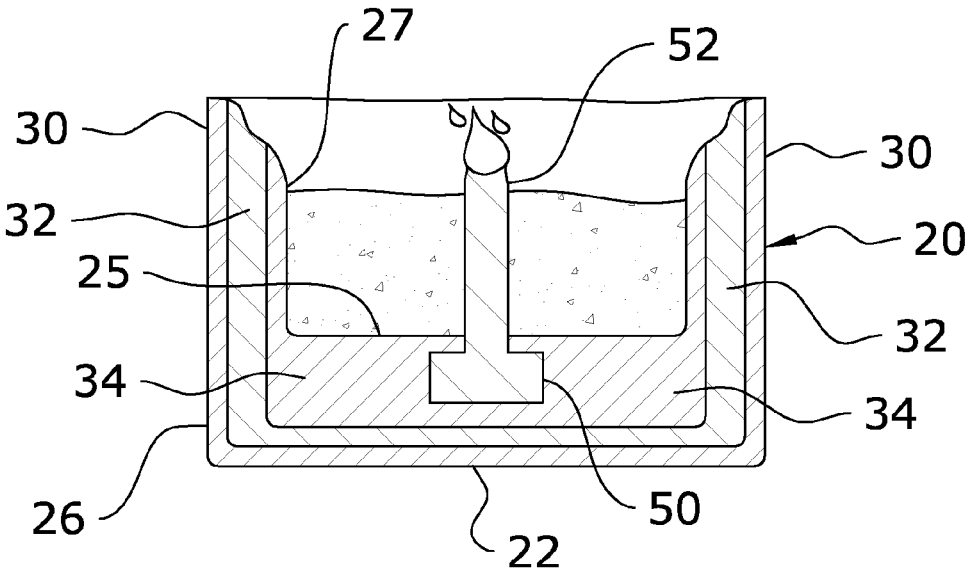
FIG. 7 is a side sectional view of the present invention after burning of the second wick.

The candle body 20 may be comprised of one or more layers of wax 30, 32, 34. In an embodiment shown in FIG. 4, two layers of wax are utilized: an outer layer of wax 30 and an inner layer of wax 34. In an embodiment shown in FIG. 5, the candle body 20 of the present invention is formed of three discrete layers of wax 30, 32, 34. In the embodiment of the present invention as shown in FIG. 5, each sidewall of the candle body 20 will be comprised of an outer layer 30, a middle layer 32 and an inner layer 34 of wax. Various types of wax or other materials known to burn and melt may be utilized, and thus the present invention should not be construed as being limited to a particular type of wax material.

The outer layer 30 of wax forms the outer surface 26 of the candle body 20. The outer layer 30 will preferably have a higher melt point than that of the middle layer 32 and inner layer 34 of wax. Such a configuration ensures that wax will melt into the central cavity 24 of the candle body 20 as the first wick 40 is burned. The outer layer 30 of wax is the last to burn, thus providing for a slightly raised perimeter and allowing melted wax to drain inward to reduce external spilling and fill the cavity 24 to create a second candle around the second wick 52.

The outer layer 30 of wax is preferably comprised of a wax material which has a melting point at least twenty degrees Fahrenheit than the melting point of the wax material comprising the middle layer 32. In a preferred embodiment, the outer layer 30 of wax will be comprised of a wax material having a melting point at or above 165 degrees Fahrenheit. In one such preferred embodiment, the outer layer 30 may be comprised of paraffin wax which includes an additive such as stearic acid, which is known to raise the melting point of wax materials. It is appreciated that other waxes and/or additives may be utilized to achieve the same result.

The outer layer 30 of wax may in some embodiments contain a fragrance additive. The use of a fragrance additive will improve the functionality of the present invention by allowing it to emit a pleasant aroma while burning. Any type of fragrance additive may be utilized so long as the melting point of the outer layer 30 of wax is accounted for.

The middle layer 32 of wax forms the central portion of the sidewalls of the candle body 20 as shown in FIG. 4. The middle layer 32 of wax contains the first wick 40 and acts as the primary burn layer of the present invention. The middle layer 32 is generally thicker than the other layers 30, 34 of the candle body 20, though alternate arrangements may be utilized.

The middle layer 32 is preferably comprised of a wax which has a lower melting point than the outer layer 30. The middle layer 32 may be pliable or rigid. The middle layer 32 of wax acts to temporarily hold wax from the outer layer 30 to make up the inner layer 34 during the construction or burning processes of the present invention.

Preferably, the middle layer 32 will be comprised of a wax material having a melting point at or below 145 degrees Fahrenheit, though the exact specifications required may vary depending on the type of wax material utilized for the outer layer 30 or the use of an additives. In some embodiments, the outer layer 30 and middle layer 32 may be comprised of the same type of wax, wherein the outer layer 30 includes an additive to create a difference between the layers' 30, 32 respective melting points.

The middle layer 32 of wax may in some embodiments contain a fragrance additive. The use of a fragrance additive will improve the functionality of the present invention by allowing it to emit a pleasant aroma while burning. Any type of fragrance additive may be utilized so long as the melting point of the middle layer 32 of wax in relation to that of the outer layer 30 of wax is accounted for. It is appreciated that the middle layer 32 of wax may include a fragrance additive which is different from the fragrance additive included in the outer layer 30.

The inner layer 34 of wax forms the inner surface 27 of the candle body 20 as shown in FIGS. 4 and 5. The inner layer 34 is preferably comprised of a wax material which has a lower melting point than the outer layer 30. The inner layer 34 may be comprised of a wax material which includes the same or a lower melting point than that of the middle layer 32, if present.

The thickness of the inner layer 34 of wax will preferably not exceed the thickness of the middle layer 32 of wax if they have similar melting points. The thickness of the inner layer 34 of wax may exceed the thickness of the middle layer 32 in some embodiments so long as the inner layer 34 is comprised of a wax material with a lower melting point than that of the middle layer 32. In any case, the inner layer's 34 thickness should not exceed the capable melt radius of the first wick's 40 flame; which could lead to improper drainage of melted wax.

The inner layer 34 wax may in some embodiments contain a fragrance additive. The use of a fragrance additive will improve the functionality of the present invention by allowing it to emit a pleasant aroma while burning. Any type of fragrance additive may be utilized so long as the melting point of the middle layer 34 of wax in relation to that of the outer layer 30 and middle layer 32 of wax is accounted for. It is appreciated that the inner layer 34 of wax may include a fragrance additive which is different from the fragrance additive included in the outer layer 30 and/or middle layer 32.

C. First Wick

The present invention will generally utilize a first wick 40 which is helically wound through the candle body 20 as shown in FIG. 1. In a single layer embodiment, the first wick 40 will be helically wound through a central portion of the single layer of wax. In a dual layer embodiment, the first wick 40 will generally extend adjacent the meeting point of the two layers 30, 34 of wax. In a three layer embodiment, the first wick 40 will preferably be encased entirely within the middle layer 32 of wax as shown in FIG. 5.

The first wick 40 includes a first end 42 and a second end 43, wherein the first end 42 of the first wick 40 extends out of the upper end 21 of the candle body 20 as shown in FIG. 1. The second end 43 of the first wick 40 terminates within the middle layer 32 of wax as shown in FIG. 4.

Various types of wicks may be utilized for the first wick 40. Preferably, a flexible or semi-rigid wick such as a braided wick will be utilized so as to allow it to be helically wound in a spiral through the candle body 20. In a preferred embodiment, the first wick 40 will be comprised of a braided wick with a cotton core. However, it is appreciated that various other types of wicks may be utilized for the first wick 40, and thus the scope of the present invention should not be construed as being limited to any particular type of configuration of first wick 40.

D. Second Wick

The present invention will generally include a second wick 52 as shown in FIG. 1. The second wick 52 is utilized to form a second candle comprised of the melted wax from the layers 30, 32, 34 of the candle body 20 as shown in FIG. 2.

The second wick 52 will generally be positioned within a wick holder 50. The wick holder 50 is secured within the lower surface 25 of the cavity 24 as shown in FIG. 4. Preferably, the second wick 52 will be removably secured within the wick holder 50, though other configurations may be utilized. The wick holder 50 will preferably be placed in the center of the lower surface 25 of the cavity 24 and embedded into the inner layer 34 of wax as shown in FIG. 4.

The second wick 52 will preferably be comprised of a rigid wick meant to uniformly burn. The second wick 52 will preferably be comprised of a length which is at least half the length from the lower end 22 to the upper end 21 of the candle body 20. Further, the second wick 52 will preferably be comprised of a material which may be easily cut or trimmed to size after the initial burning of the candle 10.

In a preferred embodiment, the second wick 52 will be comprised of a wooden wick. Such a configuration allows for the second wick 52 to be removed from the wick holder 50 and written on. Various messages may be written on the second wick 52, such as a name or event. The second wick 52 may then be placed back into the wick holder 50 and allowed to burn.

E. Operation of Preferred Embodiment

In use, the first end 42 of the first wick 40 is lit with a flame. The first wick 40 will burn, acting to melt first the inner and middle layers 32, 34 and then the outer layer 30 of wax into the cavity 24 of the candle body 20. All melted wax will drain into the central cavity 24 of the candle body 20, partially filling it up as the first wick 40 burns.

After the first wick 40 has completed burning, a second candle will have formed from the melted wax of the inner, middle and outer layers 30, 32, 34 pooling and collecting on the lower surface 25 of the central cavity 24 of the candle body 20 as shown in FIG. 2. The second wick 52 will extend upwardly from the melted wax collected within the cavity 24. The second wick 52 will preferably be cut down to size that it is not an excessive length compared to the depth of the collected, melted wax. Optionally, the second wick 52 may be removed and a message written thereon before replacing within the wick holder 50 and allowing to burn.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A self-filling candle, comprising:

A candle body, wherein said candle body is comprised of a hollow wax configuration having a cavity formed therein; and Wherein said candle body includes an outer layer of wax, wherein said candle body includes an inner layer of wax, wherein a melting point of said outer layer of wax is higher than that of said inner layer of wax, wherein said outer layer of wax is comprised of less thickness than said inner layer of wax; and Wherein said inner layer of wax is comprised of paraffin wax; and Wherein said outer layer of wax is comprised of paraffin wax treated with an agent adapted to raise the melting point of said outer layer of wax; and A first wick helically wound within said candle body, wherein said first wick is comprised of a braided, flexible wick; and A second wick positioned vertically within a lower surface of said candle body within said cavity, wherein said second wick is comprised of wood; and Wherein said first and second wick are within the same wax candle body.

2. The self-filling candle of claim 1, wherein said agent is comprised of stearic acid.

3. The self-filling candle of claim 1, wherein said second wick is rigid.

4. The self-filling candle of claim 1, further comprising a wick holder positioned within said lower surface of said candle body within said cavity, wherein said second wick is removably secured within said wick holder.

5. The self-filling candle of claim 1, wherein said inner layer is comprised of a fragrance additive.

6. The self-filling candle of claim 1, wherein said outer layer is comprised of a first type of wax and said inner layer is comprised of a second type of wax.

7. A self-filling candle, comprising:

a candle body, wherein said candle body is comprised of a hollow configuration having a cavity formed therein;

wherein said candle body includes an outer layer of wax;

wherein said candle body includes an inner layer of wax;

wherein said candle body includes a middle layer of wax, wherein a melting point of said outer layer of wax is higher than a melting point of said inner layer and said middle layer of wax;

wherein said outer layer of wax is comprised of less thickness than said inner layer of wax; and wherein said inner layer of wax is comprised of paraffin wax; and wherein said outer layer of wax is comprised of paraffin wax treated with an agent adapted to raise the melting point of said outer layer of wax; and a first wick helically wound within said middle layer of wax; and a second wick positioned within a lower surface of said candle body within said cavity.

8. The self-filling candle of claim 7, wherein said middle layer of wax is comprised of paraffin wax.

9. The self-filling candle of claim 8, wherein said agent is comprised of stearic acid.

10. The self-filling candle of claim 7, wherein said melting point of said middle layer of wax is equal to a melting point of said inner layer of wax.

11. The self-filling candle of claim 7, wherein said melting point of said middle layer of wax is greater than a melting point of said inner layer of wax.

12. The self-filling candle of claim 7, wherein said outer layer is comprised of a first type of wax, wherein said middle layer is comprised of a second type of wax and wherein said inner layer is comprised of a third type of wax.

13. A self-filling candle, comprising:

a cylindrical candle body, wherein said candle body is comprised of a hollow configuration having a cavity formed therein;

wherein said candle body includes an outer layer of wax;

wherein said candle body includes an inner layer of wax;

wherein said candle body includes a middle layer of wax, wherein a melting point of said outer layer of wax is higher than a melting point of said inner layer, wherein said melting point of said outer layer of wax is higher than a melting point of said middle layer, wherein said melting point of said inner layer of wax is equal to or less than said melting point of said middle layer of wax;

wherein said outer layer of wax is comprised of less thickness than said inner layer of wax; and wherein said inner layer of wax is comprised of paraffin wax; and wherein said outer layer of wax is comprised of paraffin wax treated with an agent adapted to raise the melting point of said outer layer of wax; and a first wick helically wound within said middle layer of wax, wherein said first wick is comprised of a flexible, braided wick; and a second wick positioned within a lower surface of said candle body within said cavity, wherein said second wick is comprised of wood.

* * * * *